US005119051A

United States Patent [19]

Myer

[11] Patent Number: 5,119,051

[45] Date of Patent: Jun. 2, 1992

[54] CAVITY-TUNING COAXIAL COUPLER UNIT

[75] Inventor: Robert E. Myer, Denville, N.J.

[73] Assignee: AT&T Bell Laboratories, Murray Hill, N.J.

[21] Appl. No.: 703,233

[22] Filed: May 20, 1991

[51] Int. Cl.[5] ..... H01P 7/06

[52] U.S. Cl. ..... 333/233; 333/26; 333/125; 333/33; 330/295

[58] Field of Search ..... 333/233, 136, 26, 125, 333/260, 127, 137, 254, 33, 232, 227; 330/295, 286, 53, 56, 124 R

[56] References Cited

U.S. PATENT DOCUMENTS 4,724,400 2/1988 Luettgenau ..... 330/295
4,967,168 10/1990 Bacher et al. ..... 333/26
5,001,443 3/1991 Martin ..... 333/26
5,032,798 7/1991 Myer ..... 333/137 X

*Primary Examiner*—Eugene R. LaRoche
*Assistant Examiner*—Ali Neyzari
*Attorney, Agent, or Firm*—R. F. Kip, Jr.

[57] ABSTRACT

A coaxial coupler unit has an outer conductor fastened to the outside of a first rigid metallic wall on one side of a microwave cavity, and the unit also has an inner conductor having at its front end an axially-fixed, angularly-turnable pin axially extending through a port in such first wall through said cavity to be inserted on the cavity's opposite side in a hole in a second deformable metallic wall bounding such side of the cavity. The pin has helical threads thereon engaging helical threads on the inside of the hole. The pin may, while remaining axially fixed, be angularly turned in opposite directions to displace the deformable cavity wall in opposite axial directions relative to the rigid cavity wall to thereby tune the cavity.

8 Claims, 3 Drawing Sheets

CAVITY-TUNING COAXIAL COUPLER UNIT

TECHNICAL FIELD

This invention relates generally to assemblages of components comprising a coaxial coupler unit and microwave confining means comprising one or more cavities permitting propagation therein of high frequency electromagnetic wave energy, such assemblages being adapted to effect transfer of such energy from one to the other of such components. More particularly, this invention relates to assemblages of such kind in which two metallic wall means are disposed on opposite sides of the cavity and have respective portions which are variable in their mutual spacing, and in which the coaxial coupler unit is adapted both to transmit microwave energy to or from the cavity and to vary the spacing between such portions so as to tune the cavity in respect of the frequency at which it is resonant.

BACKGROUND OF THE INVENTION

On Feb. 9, 1988, U.S. Pat. No. 4,724,400, entitled "Linear Amplifier Assembly" was issued in the name of G. G. Luettgenau to TRW Inc. (the "400 Patent"). Such patent is treated herein solely as a publication. The disclosure of the '400 patent as a publication is, however, incorporated herein by reference and made a part hereof.

The '400 patent shows and describes a microwave splitter-combiner apparatus comprising a cylindrical stack of vertically superposed circular metallic plates defining within the stack an upper splitter waveguide and a lower combiner waveguide. Each such waveguide comprises a pair of vertically spaced metallic walls and a chamber between and bounded by such walls and providing a passage through which microwaves propagate, the chamber being essentially in the form of a horizontal cylindrical disc. In the splitter waveguide, the microwaves travel through its cylindrical chamber from its center radially outward while, in the combiner waveguide, such travel in its chamber is radially inward towards the center of the chamber.

Disposed on a plate member providing a top closure for the mentioned stack is a set of twenty r.f. amplifier operating units each essentially in the shape of a rectangular block. The twenty units are equiangularly spaced in carousel fashion around the top of such member in respective radial planes which are vertical and pass through the vertical axis of the stack.

Each of such twenty r.f. amplifier units is coupled to the splitter waveguide by an input coaxial connector and to the combiner waveguide by an output coaxial connector. In the operation of the apparatus, high frequency electromagnetic energy is fed to the splitter waveguide's center, travels therefrom radially outward through the waveguide's chamber to the twenty input connectors and is then fed upward by them to the twenty amplifiers which operate in parallel to amplify such energy. The amplifier energy is then fed via the twenty output connectors to points in the combiner waveguide's chamber which are radially outward of the chamber's center. From those points the energy travels as waves radially inward through the chamber to its center to there be combined and provide an amplified output from the apparatus.

In the apparatus of the '400 patent, the input microwave energy is supplied to the upper splitter cavity via an input coupling unit described in that patent as a coaxial type connector and the amplified microwave energy is tapped off from the lower combiner cavity by another similarly described coupling unit. Both such connectors are best depicted in FIG. 5*a* of the patent, and the inner conductor of each of such type connectors is shown in that figure as being a constant diameter smooth-surfaced pin and as having its front end received in a constant diameter smooth-bore hole formed in one of the metallic cavity bounding plates.

Improvements on the splitter-combiner apparatus of the '400 patent are disclosed in my co-pending U.S. patent application Ser. No. 472,160, filed Jan. 30, 1990 and assigned to the assignee hereof, and incorporated herein by reference and made a part hereof (hereafter referred to as "Myer 18"). Among such improvements is a construction of the apparatus wherein the top and bottom sides of, respectively, the upper splitter cavity and the lower combiner cavity are bound by upper and lower rigid aluminum plates, whereas the bottom and top sides of, top sides of, respectively, the upper cavity and the lower cavity are bounded by, respectively, upper and lower aluminum sheet metal dishes separated from each other by a gap. For each of such cavities, there is a coaxial coupler unit having an outer conductor coupled to the rigid plate on one side of that cavity, and having, also, an inner conductor passing through a port in such plate at the radial center of the cavity, and then extending along the axis of the cavity vertically through it to contact the sheet metal dish on the cavity's opposite side.

Such coupler unit may serve as an input or output for microwaves, as the case may be, and the coupler unit may be as disclosed in U.S. Pat. No. 5,001,443 for "Coaxial-Waveguide Assemblages", issued Mar. 19, 1991 in the name of James N. Martin and assigned to the assignee hereof and incorporated herein by reference and made a part hereof.

Because the mentioned dish is of sheet metal, it is somewhat deformable so that the dish has a portion capable of variable axial spacing with a corresponding portion of the rigid plate on the cavity's opposite side. Advantage is taken of that fact to provide for tuning of the resonant frequency of the cavity in a manner as follows.

The rigid plate has therein a vertical threaded hole radially offset from the cavity axis. A threaded dielectric screw extends vertically from the outside of such plate through such hole and beyond it to a front end in contact with the dish. Turning of the screw in one direction advances the screw in the hole to displace the dish away from the plate bounding the other side of the cavity. Subsequent displacement, if any, of the dish towards such plate is effected by having a compression spring in a compressed state in the gap between the two metal dishes, and by using the spring force to produce such displacement while concurrently turning the screw in the angular direction permitting that displacement to take place. The variation caused by so displacing the dish in either vertical direction will vary the spacing between portions of the plate and dish on opposite sides of the cavity so as to vary its resonant frequency.

While such mode of tuning the cavity is satisfactory, it has the shortcomings that the insulative screw is not as dimensionally stable as is preferable, the screw is off-axis to tend to produce asymmetry in the deformation of the dish as its center portion is displaced, an asymmetry in the electrical characteristics of the cavity may be produced by the presence therein of the screw.

SUMMARY OF THE INVENTION

One or more of the above shortcomings are overcome, according to the invention, by providing a coaxial coupler unit adapted both to transmit microwave energy to or from the cavity, as the case may be, and to tune the cavity in its resonant frequency. Such coupler unit comprises, a tubular metallic outer conductor having an axis and terminating at a front end, inner metallic conductor means having a first length positionally fixed in relation to such outer conductor and disposed at least partly coaxially within it, and having, also, a second length comprising a metallic pin coaxial with such outer conductor and at least partly disposed forward of such conductor's front end, and coupling means electrically coupling said first length and pin and mechanically guiding said pin to keep it substantially aligned with said axis while enabling such pin to undergo adjustment through a range of settings in its positioning relative to such outer conductor, the coupling means including means to hold such pin at a selected setting thereof within such range. The pin adjustment just referred to is of a kind adapted to cause or promote variation in the spacing between respective portions of metallic wall surfaces bounding opposite sides of the cavity so as, by such variation, to tune the cavity. Thus, for example without restriction, such adjustment may be an axial adjustment of the pin which (as earlier described in connection with Myers 18) operates in conjunction with reactive force on the dish from a compression spring to vary the displacement of the dish relative to a reference position therefor. Preferably, however, the pin is kept axially fixed relative to the outer conductor of the coupler unit, and displacement of the dish is effected solely by angular turning of the pin in a manner later described in detail.

BRIEF DESCRIPTION OF THE DRAWING

For a better understanding of the invention, reference is made to the following description of a splitter-combiner apparatus including apparatus and a coaxial coupler unit embodying the invention, and to the accompanying drawings wherein.

DETAILED DESCRIPTION

Figure 1:
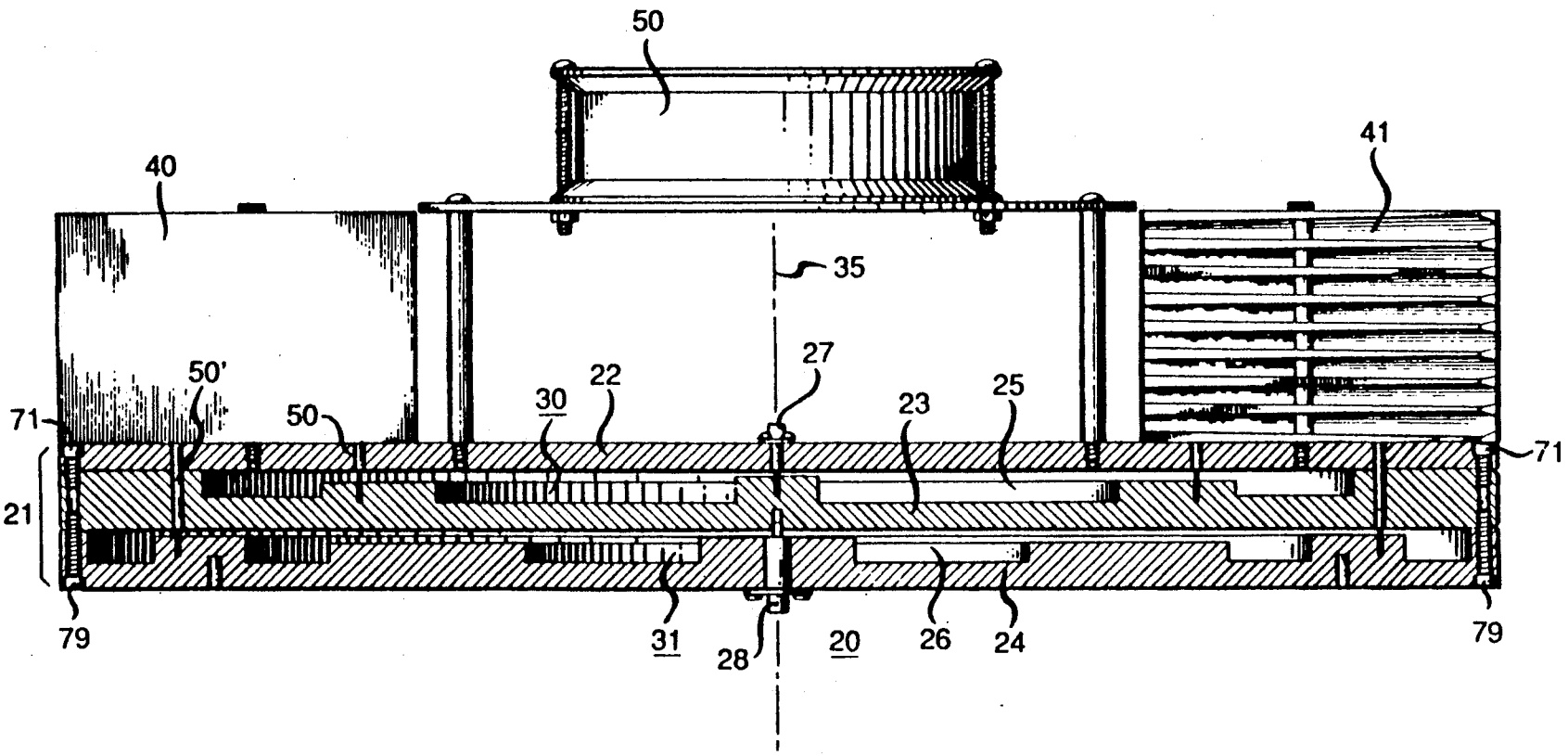
FIG. 1 (PRIOR ART)
FIG. 1 is a front elevational cross-sectional schematic view of a splitter-combiner appartus incorporating features of the invention but lacking cavities which are tunable according to the invention.

Referring now to FIG. 1, the reference numeral 20 designates a splitter-combiner and amplifying apparatus comprising a circular cylindrical vertical stack 21 of superposed, circular, aluminum horizontally-disposed plate members all at d.c. ground and constituting an upper member 22, a middle member 23 and a lower member 24. While the bottom of member is planar, the confronting top of member 23 is selectively inwardly recessed as shown to define between the members a chamber 25 containing a dielectric material (e.g., air) and in the form of a cylindrical disc. The chamber 25 is bounded on its vertically opposite sides and around its periphery by two metallic wall means provided by the portions adjacent to the chamber of members 22,23, and such metallic wall means, together with chamber 25, constitute an upper splitter cavity or waveguide 30 adapted to receive high frequency electromagnetic energy via a coaxial input terminal 27 at the waveguide's radial center. Similarly, there is defined between the members 23 an 24 a cylindrical disc chamber 26 which is bounded by two metallic wall means provided by portions of such members, and which chamber, together with the latter two wall means, constitutes a lower combiner cavity or waveguide 31 adapted to provide an output of high power, high frequency electromagnetic energy via an output coaxial-terminal 28 at the radial center of the combiner waveguide.

Upper member 22 supports on its top a ring of twenty r.f. amplifier modules equiangularly spaced around that member. Each such module comprises a housing and, within that housing, the amplifier's operating unit which has the overall structure of a thin rectangular block. FIG. 1 shows, in respect of the amplifier modules mounted on stack 21, only the amplifier block 40 of the most leftward amplifier module and the housing 41 of the most rightward amplifier module. Block 40 is (like the blocks of the nineteen other amplifier modules) disposed in relation to the stack 21 on which it is mounted to lie in a plane which contains the vertical axis 35 of the stack and is, thus, a radial plane therefor. Block 40 projects upward from stack 21 like a fin.

The amplifier block is supplied from splitter waveguide 30 with high frequency electrical energy at 860–896 MHz via an input coaxial coupling unit 50, and such block in turn provides a supply of such energy as amplified to the combiner waveguide 31 via an output coaxial coupling unit 50'. Those two coupling units may be the same as or similar to the corresponding coupling units disclosed in U.S. Pat. No. 4,967,168 issued Oct. 30, 1990 in the name of Edward V. Bacher and Robert E. Myer for "Coaxial-Wave Guide Coupling Assemblages" and assigned to the assignee hereof. Such patent is incorporated herein by reference and made a part hereof.

The operation of the FIG. 1 apparatus will be apparent from the description already given. Briefly, high frequency electromagnetic wave energy is supplied via terminal 27 to splitter waveguide 30 to be distributed within it to the twenty input coaxial coupling units for the twenty amplifiers of the apparatus. That energy is amplified by such amplifiers and is subsequently piped by the twenty output coaxial units to combiner waveguide 31 in which it is combined with the energy from the other r.f. amplifiers, and the combined energy is then tapped from that waveguide at its output terminal 28.

Figure 2:
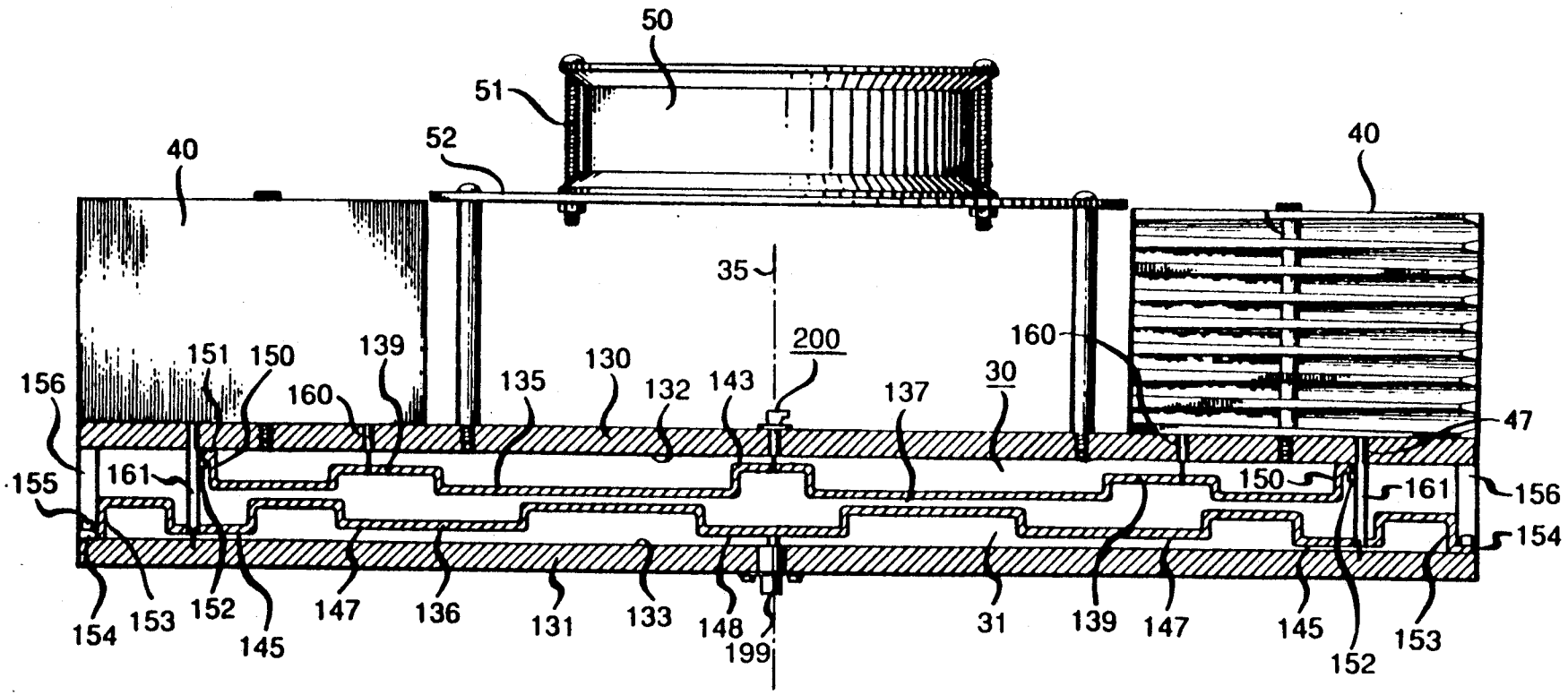
FIG. 2 (PRIOR ART)
FIG. 2 is a front elevational cross-sectional of the FIG. 1 embodiment as improved to provide cavities of which each is tunable, according to the invention, by a coaxial coupler unit embodying the invention.

In the modification shown by FIG. 2 of the FIG. 1 embodiment, the top and bottom wall means of the cavity closure structure are respectively provided by two flat circular constant-thickness metallic rigid aluminum end plates 130 and 131. Top end plate 130 at its lower surface 132 provides a metallic wall portion bounding the upper side of divider cavity 30. Similarly, bottom end plate 131 at its upper surface 133 provides a metallic wall portion bounding the lower side of combiner cavity 31.

In FIG. 2, the central wall means of the cavity closure structure comprises upper and lower dishes 135 and 136 which are constituted of aluminum sheet metal and are on vertically opposite sides of a gap 137 between the plates. Those plates 135, 136 provide metallic wall portions bounding respectively the cavities 30 and 31.

The sheet metal dishes 135 and 136 are thin as compared, for example, to the end plates 130 and 131. Because of such thinness of the dishes 135 and 136, they each are somewhat flexible. That is, such dishes are resiliently deformable to the extent that plates 135, 136 are, radially inward of their circumference capable of variable spacing in the axial direction relative to rigid plates 130 and 131.

The sheet metal dishes are shaped by stamping or other machine working to each have an alternation therein of concentric ridges and valleys. Specifically, dish 135 has annular bends or flexures therein forming in such plate ridges 139 and 143 which face toward the interior of the upper cavity 30. Similarly, dish 136 has annular bends or flexures therein forming in the latter plate the ridges 145, 147 and 148 which face toward the interior of the lower cavity 31, such bends or flexures also providing valleys between such ridges.

Upper sheet metal dish 135 is shaped by, say, stamping to have at its periphery, first, a cylindrical flange 150 vertically upstanding from the reference plane for the plate and, second, an annular rim 151 integral with and horizontally projecting radially outward of the outer (i.e., upper) margin of flange 150. A plurality of vertical bolts 152 are spaced equiangularly around rim 151 and pass up through holes therein into threaded holes in top plate 130 to fasten the plates 130 and 135 together.

Analogously, lower sheet metal dish 136 is shaped to have at its periphery a cylindrical flange 153 downstanding from the plate's reference plane and, also, an annular rim 154 integral with, and horizontally projecting radially outward of, flange 153 at its bottom. A plurality of vertical bolts 155 are spaced equiangularly around rim 154 and pass down through holes therein into threaded holes in bottom plate 131 to fasten together the plates 131 and 136.

The two end plates 131 and 132 are held spaced apart by a plurality of arcuate sleeve segments 156 vertically disposed between rim 154 of dish 136 and the underside of plate 130 and angularly distributed around the periphery of rim 154 in interspersed relation with the bolts 155. The assembly of plate 130 and dish 135 and the assembly of plates 131 and dish 136 are fastened together by bolts 71 and 79 which are shown in FIG. 1 (although not in FIG. 2) and which, in the FIG. 2 modification, pass through holes in plate 130 (in the case of bolts 71) and through holes in the plate 131 and rim 154 (in the case of bolts 79) and, from there, into threaded receptacle holes therefor (shown in FIG. 4) formed in the sleeve segments 156. At least two bolts 71 and two corresponding bolts 79 are received in angularly spaced ones of such threaded holes in each of sleeve segments 156.

The amplifier modules 40 are electrically coupled to the upper divider cavity 30 and the lower combiner cavity 31 by, respectively, the input coaxial connector units 160 and the output coaxial connector units 161. Units 160 and 161 correspond, respectively, to the input and output couplers 50 and 50′ of FIG. 1 but have the structures which are disclosed for such coaxial connector units in the aforementioned Bacher et al patent.

Figure 3:
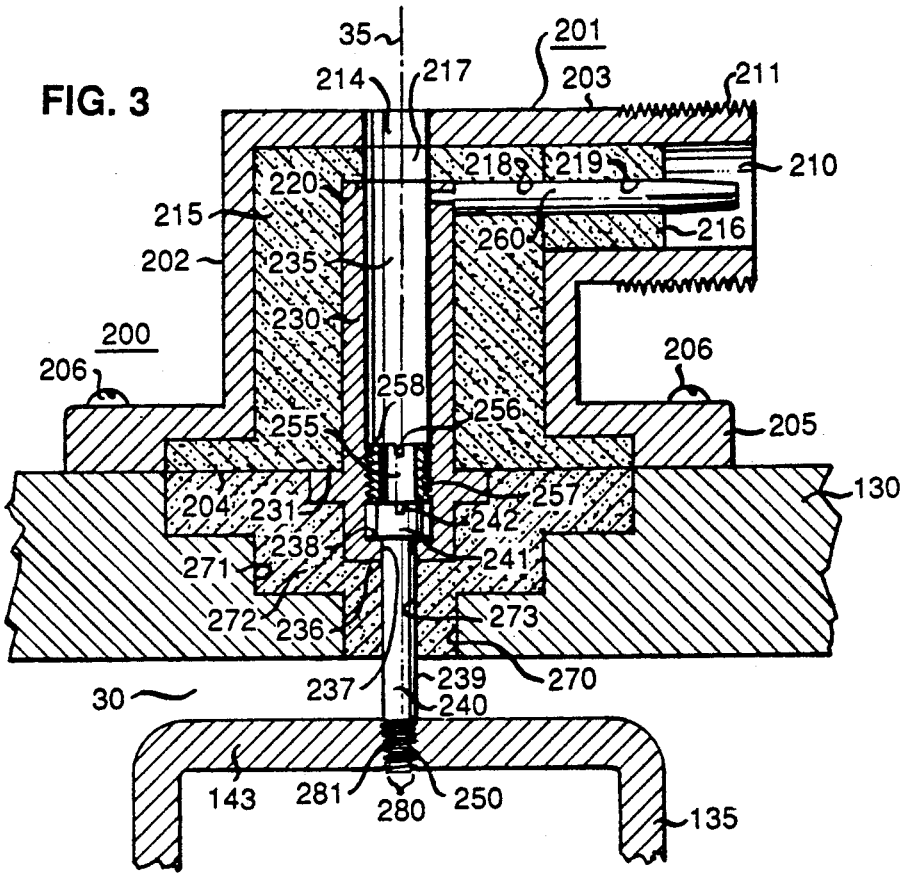
FIG. 3 is an enlarged view in front elevational cross-section of such a coaxial coupler unit.
Figure 4:
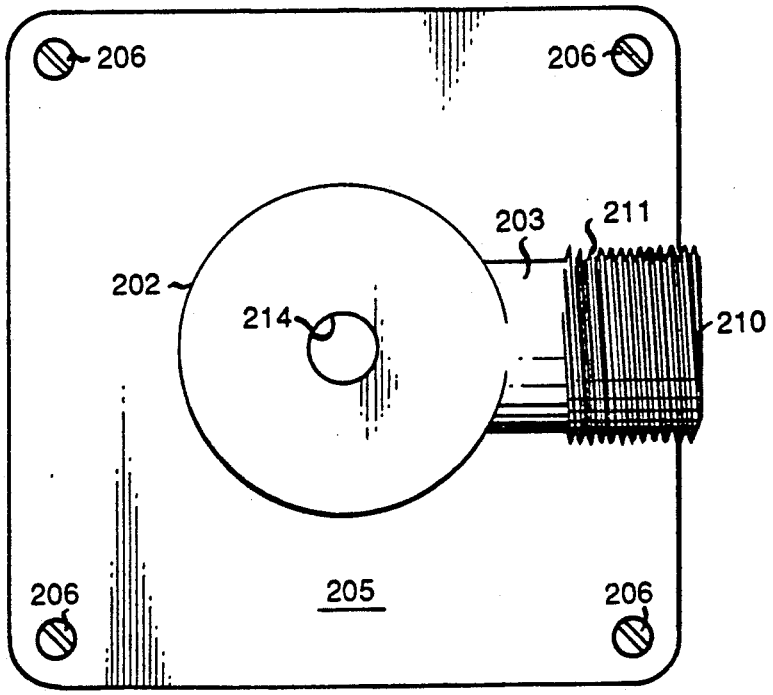
FIG. 4 is a plan view of the FIG. 3 coupler unit.

Microwave energy is piped to cavity 30 and tapped from, cavity 31 via, respectively, an input coaxial coupler unit 200 and an output coaxial coupler unit 199. Unit 199 is essentially the same in structure as the unit 200. Details of the unit 200 are shown in FIGS. 3 and 4.

Referring to those latter figures, the coupler unit 200 comprises an aluminum outer tubular outer conductor 201 having a circular-cylindrical metallic tubular forward section 202 and a rear circular-cylindrical metallic tubular section 203. The forward section 202 is radially symmetrically disposed about vertical cavity axis 35, and that forward section terminates in the downward direction in a front end 204 at which a square mounting flange 205 projects radially outward from the otherwise cylindrical exterior of the section. The unit 200 is electromechanically coupled with the upper rigid plate 130 of the cavity closure structure by threaded bolts 206 passing through unthreaded holes (not shown) in flange 204 into threaded holes (not shown) formed in the plate 130.

The rear section 203 of outer conductor 201 is disposed at the top of and normal to its forward section 202, and it has a leftward end integrally joined with section 202 and a rightward end providing a jack inlet 210 for the coupler unit. At that rightward end, the conductor section 203 has thereon external threading 219 permitting the threaded connection to jack inlet 210 of the conventional end fitting of a flexible coaxial cable (not shown) leading to the apparatus 20 from an antenna or some other source of microwave energy to be amplified.

The forward conductor section 202 has at its rear end a circular hole 214 centered on axis 35 and passing vertically through the wall of the outer conductor 201. The forward and rear sections 202 and 203 of that conductor contain respective dielectric sleeves 215,216 press fitted into those sections. Sleeve 215 has a vertical primary hollow core 217 coaxial with hole 214 and a horizontal secondary hollow core 218 coaxial with rear section 203 and intersecting core 217. Sleeve 216 has therein a hollow core 219 aligned with, and of the same diameter as, core 218 and providing an extension thereof to the jack inlet 210. Core 217 has formed in it near its top an annular shoulder 220 reducing the diameter of the core above that shoulder. The cores 217–219 are provided in the dielectric sleeves 215,216 to accommodate therein various parts of an inner conductor means which is included in coupler unit 220, and which will now be described.

A first length, and important element, of such inner conductor means is provided by a bushing 230 forced upwardly into the core 215 in dielectric sleeve 217 until its further upward movement is arrested by the positioning of the top of the bushing against or near shoulder 220 or the coming into axial contact with the bottom of sleeve 215 of an annular stop flange 231 integral with the bushing. Flange 231 is located on the bushing about ¼ of the length of the bushing up from its bottom. Thus, most of bushing 230 is disposed within outer conductor section 202 although a minor part of it projects axially forward of the front end 204 of that section.

The interior of bushing 230 is in the form of an axially extending cylindrical bore 235 registering at its top with hole 214 in outer conductor 201 and coaxial with that hole. The bushing 230 at its lower end is shaped to have a diaphragm 236 extending across the bottom of the bushing 235 to close it off except for a solid circular-cylindrical hole 237 coaxial with hole 214 and smaller in diameter than bore 235 and passing vertically downward through the diaphragm. To put it another way, the diaphragm and hole therein serve to configure the forward end of the bushing bore to have in it an annular shoulder 238 surrounding the rear opening of a reduced diameter neck 237 for such bore, and by which such bore is continued to the front of the bushing.

A second length of the inner conductor means of coupler unit 200 is provided by a circular cylindrical pin 240 having a stem 239 projecting axially beyond the front end 204 of forward tubular section 202 of the outer conductor 201. The major portion of stem 239 is forward of the front end of bushing 230. A minor rear portion of the cylindrical stem of the pin 240 passes, however, with a close fit, upward through the reduced diameter bushing neck 237 to a head 241 provided for the pin and at its back end. Head 241 is circular cylindrical in shape, is radially enlarged to have a close fit with bushing bore 235, and is seatable on the annular shoulder 238 provided by the top surface of diaphragm 236. Head 241 has in its top a slot 242. Because of the close fit of pin stem 239 in the reduced diameter bore section 237 and of pin head 240 in the normal diameter bore section 235, the bushing 230 keeps pin 240 substantially aligned with the cavity axis 35 in the course of any axial or angular movement of the pin.

The stem 239 of pin 240 has helical threads 250 formed thereon at its front end. The purpose of such external threading will be later described.

The bore 235 of bushing 230 contains directly above pin 240 an annular plug 255 having a central vertical passage through it and, also, a pair of slots 256 (only one shown) formed in the upper rim of the plug on diametrically opposite sides of such passage. Plug 255 has external helical threading 257 engaging with internal helical threading 258 in the bore to permit advancement or retraction of plug 255 in bore 235 by angular turning of the plug. Plug 255 may be advanced far enough to eliminate any axial movement of pin head 241 between the plug and shoulder 238 except for slight play. For that disposition of the plug, the plug 255 and bushing 230 provide for pin 240 a swivel coupling which, although keeping the pin aligned with axis 35 and fixed in axial position, nonetheless allows the pin to angularly turn through a range of angular settings therefor. The plug, however, may then be advanced further to squeeze pin head 241 between itself and the bushing internal shoulder 238 to thereby clamp or hold pin at a selected setting thereof within such range.

A third length of the mentioned inner conductor means is provided by a solid circular cylindrical pin 260 extending horizontally from a tapered tip of the pin in jack inlet 210 and, with a close fit, through cores 219 and 218 in, respectively, dielectric sleeves 216 and 215 to a junction with bushing 230. Such junction is provided by having external threading on the left hand end of pin 260 engage with internal threading in a tapped hole formed in bushing 230 and extending horizontally therethrough. All of the fits of bushing 230 and pin 260 within, respectively, sleeves 215 and 216, and of the fits of those sleeves within outer conductor 201, are tight enough to keep those lengths 230 and 260 of the inner conductor means fixed in position relative to outer conductor 201.

The described coupler unit 200 when bolted to cavity plate 130 is seated over a port 270 centered on cavity axis 35 and extending vertically through that plate. Port 270 has a top opening of the same diameter as opening 204 of coupler unit 200, and, from that top opening, the circumferential wall 271 of the port converges in a series of steps to the bottom opening of the port 270 into the cavity 270. The circumferential wall of the front opening 204 of the coupler unit has a similar stepped profile consisting, however, of only one step.

Port 270 is filled with a dielectric plug 272 having an exterior with a stepped profile matching the profile of wall 271. The plug 272 has formed therein a hollow core 273 with a stepped profile designed to mate with the flange 231 (and the parts below it) of the bushing 230 and with the part of stem 239 of pin 240 projecting axially downward from the bushing 230 and lying within the port.

The purpose in having the stepped profiles described above is to avoid any substantial variation in the impedance offered by the coupler unit to microwave energy in the course of its passage from the jack inlet 210 to the cavity 30. The manner in which such impedance is kept constant over the length of such passage is by substantially meeting the criterion of keeping constant over such length the ratio of the outer diameter of the inner conductor means to the inner diameter of the outer conductor means at all pairs of points in such length which are respective to such two conductor means and are radially opposite each other. Because as shown in FIG. 3, the outer diameter of the inner conductor means is irregular over its length from jack inlet 210 to the front end of pin 240, it is needed, in order to keep such ratio substantially constant, for the inner diameter of the outer conductor 201 and of the port 270 to also have an appropriate irregularity over their combined lengths from jack inlet 210 to cavity 30. Such irregularity is provided by the above described stepped profiles and by the fact that the inner diameter of conductor 201 is smaller in its rear section 203 than in the upper portion of its forward section 202 in order to compensate for the difference in the outer diameters, respectively, of pin 260 and of bushing 230 in that upper portion. While the employment of the mentioned stepped profiles does not everywhere in the FIG. 3 assemblage exactly satisfy the criterion specified above (inasmuch, as, for example, the enlarged outer diameter of step flange 231 on bushing 230 is not radially directly opposite the compensating enlarged inner diameters of coupler unit 200 at its bottom and port 270 at its top) such stepped profiles do substantially meet such criterion to reduce to an acceptable level any impedance variation seen by the microwave energy in passing through the coupler unit and the port.

As earlier stated, the pin 240 of the inner conductor means has helical threads 250 at its front end. That front end is inserted into a circular hole 280 passing vertically through the center ridge 143 of the aluminum dish 135 bounding the lower side (FIG. 2) of splitter cavity 30. The circumferential wall formed in that dish for hole 280 has thereon internal helical threads 281 engaging with the external threads 250 on the pin for a purpose to be described shortly.

Returning to FIG. 2, the output coaxial coupler unit 199 may conveniently have a structure and cooperation with lower combiner cavity 31 substantially the same as the structure of the above described coupler unit 200 and its cooperation with splitter cavity 30. Thus, both of the cavities of the FIG. 2 microwave amplifying apparatus may be equipped at its input or output port, as the case may be, with a cavity-tuning coupler unit.

USE OF THE EMBODIMENT

Considering now how the FIG. 3 coupler unit is used, one of its functions is to transmit microwave energy from an external source to cavity 30. The manner in which it performs that function is self evident. Another, however of the functions of coupler unit 200 is to frequency tune the splitter cavity. Such is done as follows.

With the plug 255 in coupler 200 being screwed down to bear firmly against pin 240 and hold it fixed in axial and angular positions, the coupler 200 of the FIG. 2 apparatus is supplied from a test signal source (not shown) with microwaves which are of constant amplitude but of which the frequency is modulated by repetitive sawtooth waves to produce over the duration of each such sawtooth wave a sweep in frequency of the microwaves. That sweep occurs over a range which has extremes outside the limits of the standard 869–896 MHz range specified for the apparatus 20 hereof so as to exceed that standard range but, on the other hand, is not much greater than that standard range. The output of amplified microwaves from one of the amplifiers 40 of apparatus 20 is fed to measuring equipment including a display terminal having a cathode ray tube connected up so that the X and Y deflections of its beam instantaneously correspond to, respectively, (a) the amplitude of the mentioned sawtooth waves and to, thus, the frequency of the input microwaves to the apparatus, and (b) the amplitude of the microwaves from cavity 30 to amplifier 40. When that cathode ray tube is so connected, the display traced out on its screen by its beam is the resonance curve of cavity 30. The cavity is tuned to bring the peak of that curve to a desired frequency (as, say, the center frequency of the 869–896 MHz range) as follows.

As a first step, a first insulative tool (not shown) having a relatively wide blade at its front end is inserted into the hole 214 in the coupler and down through the bore 235 of bushing 230 to insert such blade into the slots 256 in plug 255. That first tool is then turned to move plug 255 slightly rearward in the bore. The plug 255 when so moved keeps however, the pin 240 fixed in axial position relative to bushing 230 and outer conductor 201 except for some small axial play needed for the head 241 of the pin in order for it to freely turn angularly.

Next, with the first tool being removed from bushing bore 235, there is inserted into that bore a second insulative tool having a front end with a blade thereon of small enough diameter to pass through the central vertical passage in plug 255. The blade of that second tool is inserted into the slot 242 in the head of pin 240, and the second tool is then rotated to turn pin 240 about its axis. With, however, the pin 240 being concurrently fixed in its axial position as described, above, such angular turning of the pin operates through the engagement of its threads 250 with the threads 281 in the hole 280 in aluminum sheet metal dish 135 to produce an axial displacement of the center of that deformable dish relative to the rigid aluminum plate 130 which lies above it on the opposite side of cavity 30. Turning as described of the screw 240 in opposite angular directions will positively displace the central region of dish 135 in opposite axial directions relative to the plate 135 so as to vary in opposite directions the vertical spacing between portions respective to the upper plate and to the lower dish bounding cavity 30.

Concurrently with varying such spacing, the displayed cavity resonance curve is watched until the turning as described of pin 240 shifts the peak of the curve to the frequency at which it is desired for such peak to occur. When that point is reached, turning of the pin is discontinued and the second tool is removed from bushing bore 235. The first tool is then reinserted in the bore and utilized to turn plug 255 to advance it until it bears against pin head 241 to forcibly seat such head on the shoulder 238 in bore 235. That is, the head 241 is clamped between the plug 255 and such shoulder so that pin 240 is locked in angular position and so that any play in the axial position of the pin is eliminated. Pin 240 is kept so locked until there comes the time, if any, when it is wanted to retune cavity 30.

Lower cavity 31 may be tuned by connecting the test signal source as before to coupler unit 200, passing the microwave energy from that source through that cavity, amplifiers 40 (by which it is amplified), cavity 31 and coupler unit 199 to the output of that unit, supplying the test equipment with the microwave energy from that output, and utilizing the test procedures described above to adjust the peak of the resonance curve then shown by the cathode ray tube to a desired frequency. It will be noted that the location of that peak in the frequency dimension well be partly a function of the resonance curve of the cavity 30. Accordingly, if it is desired for both of the cavities 30 and 31 to have the same peak resonant frequency, such may be done by first tuning cavity 30 and then cavity 31 to that frequency.

The above described technique of tuning a microwave cavity by angularly turning a screw element axially fixed in position to vary the spacing between portions of metallic walls on opposite sides of the cavity is also disclosed in part in co-pending U.S. patent application Ser. No. 07/686,219, entitled "Composite Wall Closure Means for Microwave Containing Regions", and filed Apr. 16, 1991, in the name of Paul L. Bartley and the inventor hereof, such application being assigned to the assignee hereof and being incorporated herein by reference and made a part hereof ("Bartley et al"). The tuning arrangement disclosed in that case differs however from the invention hereof in that, in the Bartley et al arrangement, the screw element in insulative and is offset from the center of the cavity and is separate from the coaxial coupler unit providing a microwave input or output to the cavity. The arrangement of the present invention affords the advantages over those of Myer 18 and Bartley et al in that, in the present invention, the screw element is metallic to better promote the dimensional stability of the cavity inter-wall spacing determined by the setting of that screw element, the deformation of the cavity by adjustment of the screw element is radially symmetrical about the axis of the cavity, the screw element is part of the coupler unit so as to avoid introduction into the cavity of a separate element, and variation in the inter-wall spacing of the cavity by adjustment of the screw element cannot cause any problem in the electrical coupling of the coaxial coupler unit to the cavity.

The above described embodiment being exemplary only, it is to be understood that additions thereto, omissions therefrom and modifications thereof can be made by without departing from the spirit of the invention. For example without restriction, cavity-tuning coaxial coupler units in accordance with the present invention may be used with the microwave cavities disclosed in Bartley et al as distinct from the cavities which are shown in FIG. 2 hereof, and which shown cavities are substantially the same as the cavities disclosed in Myer 18. Accordingly, the invention hereof is not be be considered as limited save as is consonant with the recitals of the following claims.

I claim:

1. The improvement in a coaxial coupler unit for a microwave cavity on opposite sides of which are first and second metallic wall means capable of variable spacing between respective portions thereof, said unit comprising:

an outer conductor having a tubular forward section having an axis and adapted to be electrically coupled with said first wall means, said outer conductor extending from such section to a jack inlet included in such unit, and inner conductor means comprising a metallic input pin centered in said jack inlet and a metallic output pin coaxial with said section and at least partly disposed axially outward of it and having a forward part of such output pin adapted to be coupled with said second wall means, said improvement being that said inner conductor means further comprises coupling means electrically coupling said input and output pins and mechanically guiding said output pin to keep it substantially aligned with said axis while concurrently enabling such pin to undergo adjustment through a range of settings in its positioning relative to said section, such output pin being adapted by such adjustment to vary such spacing between such portions of such two wall means so as to tune said cavity, and said coupling means including means to hold such output pin at a selected setting thereof within such range.

2. The improvement according to claim 1 in which such adjustment comprises angular turning of said output pin about said axis.

3. The improvement according to claim 2 in which said coupling means is adapted to keep said output pin axially fixed relative to said section, said forward part of such output pin has threads engagable in a hole in said portion of said second wall means with threads formed in such portion to extend around said hole, and such output pin is adapted by such angular turning when so axially fixed to vary such spacing.

4. The improvement according to claim 3 further comprising a dielectric sleeve in said section of said outer conductor; and in which said coupling means comprises; a bushing at least partly disposed in said sleeve in coaxial fixed relation with said section and having therein an axial bore accessible at the rear of such bushing, said bore being configured forwardly to have therein an annular shoulder surrounding the rear opening of a reduced diameter neck by which such bore is continued to the front of such bushing; said neck having a rear part of said output pin passing therethrough, such output pin having at its back end a radially enlarged head disposed within said bore to be seatable on said shoulder, such output pin being adapted to be angularly turned by a first tool inserted into said bore to engage said head, and said improvement also comprising pin clamping means disposed in said bore and operable to selectively produce making and breaking of forcible contact between said pin head and shoulder to thereby selectively clamp and not clamp said output pin in an angular position to which it has been set.

5. The improvement according to claim 4 in which said pin clamping means comprises an externally threaded angular plug disposed in said bore behind said head and adapted to be angularly turned by a second tool inserted in said bore, said plug being threadedly engaged with the interior wall of said bore and being adapted by being so turned to selectively advance against said head to press it against said shoulder or to retract from said head so as to release it from such pressing, and said plug having an axial passage therein permitting access to said pin head by said first tool when the latter is inserted in said bore.

6. The improvement according to claim 4 in which said input pin extends normal to said bushing from said jack inlet to an electromechanical coupling of such input pin with a rear portion of said bushing, and in which said bore in said bushing registers at its rear with an axial hole formed in said outer conductor to permit insertion from the outside thereof into said bore of said first and second tools.

7. The improvement according to claim 4 in which said bushing varies in outer diameter in its axial length, and in which said tubular section of said outer conductor varies in inner diameter in its axial length so as to maintain substantially constant the ratio of said outer diameter to said inner diameter for portions of, respectively, said bushing and said tubular section which are substantially radially opposite each other.

8. An assemblage comprising: cavity closure means defining a radially extending microwave cavity having an axis, and on axially opposite sides of which are first and second metallic wall means capable of variable axial spacing between respective portions thereof radially centrally located within said cavity, and a coaxial coupler unit for conducting microwave energy between said cavity and a location external thereto, said coupler unit comprising: an outer metallic conductor having a tubular section coaxial about said axis and terminating at a front end at which such conductor is adapted to be electrically coupled to said first wall means, inner conductor means disposed in coaxial relation with said section and axially extending through an aperture in said first wall means into said cavity, said inner conductor means comprising a first axial length positionally fixed relative to said section and disposed at least partly within it and, also, a second axial length comprising a metallic pin disposed at least partly forward of said section's front end and having a forward part of such pin adapted to be coupled with said second wall means, and coupling means electrically coupling said first length pin and mechanically guiding said pin to keep it substantially aligned with said axis while concurrently enabling said pin to undergo adjustment through a range of settings in its positioning relative to said section, such pin being adapted by such adjustment to vary said spacing between such portions of said two wall means so as to tune said cavity, and said coupling means including means to hold such pin at a selected setting thereof within such range.

* * * * *